United States Patent [19]

Felice et al.

[11] Patent Number: 4,479,461

[45] Date of Patent: Oct. 30, 1984

[54] COIL SPRING DAMPER FOR VALVE ASSEMBLIES OF INTERNAL COMBUSTION ENGINES

[75] Inventors: Mario J. Felice, Dearborn Heights; Walter T. Mayers, West Bloomfield, both of Mich.

[73] Assignee: Ford Motor Company, Dearborn, Mich. ; by said Mario J. Felice

[21] Appl. No.: 398,501

[22] Filed: Jul. 15, 1982

[51] Int. Cl.[3] ..... F01L 1/00

[52] U.S. Cl. ..... 123/90.65; 123/188 SC

[58] Field of Search ..... 123/90.65, 90.66, 90.67, 123/188 SB, 188 SA; 267/136, 166, 167, 169

[56] References Cited

U.S. PATENT DOCUMENTS

| | | | |
|---|---|---|---|
| 1,191,658 | 7/1968 | Brown | 123/90.67 |
| 1,331,826 | 2/1920 | Shepherd | 123/188 SA |
| 1,928,678 | 10/1933 | Sjolander | 123/90.66 X |

*Primary Examiner*—Michael Koczo
*Assistant Examiner*—Peggy A. Neils
*Attorney, Agent, or Firm*—Peter D. McDermott; Roger L. May

[57] ABSTRACT

A vibration damper for a coil spring 16 includes a cylindrical shaped sleeve 18 which receives the coil spring 16 such that the outer portions 38 of the coils 36 slidably abut the inside surface of wall 20 of the sleeve 18 to provide frictional damping of the coil spring as it axially compresses and elongates.

16 Claims, 7 Drawing Figures

COIL SPRING DAMPER FOR VALVE ASSEMBLIES OF INTERNAL COMBUSTION ENGINES

BACKGROUND OF THE INVENTION

1. Field of the Invention:

This invention relates to coil spring dampers and, more particularly, to coil spring dampers for valve assemblies in internal combustion engines.

2. Disclosure Information:

It has long been known that a coil spring is well suited for providing a biasing force for a valve assembly that must undergo repetitive reciprocal motion. Engine tappet valves are usually biased to a closed position by coil springs. The valves are repetitively opened by mechanical actuators against the closing bias of the spring. When engines run at high speed, the tappet valves repetitively open and close at high frequencies. At these high frequencies, it is known that coil springs may resonate and start to vibrate and oscillate in an undesired fashion which may interfere with its desired functions.

Various devices and techniques to damp the resonance of the coil spring are known. A metal cylinder positioned within the inner diameter of the coil spring such that the inside portion of the coils frictionally slide against the cylinder damps the resonating motion of the spring. However, the cylinder by being on the inside of the coil spring rubs against the high stress areas of the coils. It is desirous to eliminate the frictional engagement of a damper with the high stress area; i.e., the inner diameter portion of the coil spring.

It is known to use a second coil spring to damp motion of the main coil spring. The second spring is wrapped on the inside or outside of the coil. This secondary spring is disclosed in U.S. Pat. No. 1,928,678 issued to Sjolander on Oct. 3, 1933. The disadvantage of the secondary spring is that it adds an additional load which must be overcome to open the valve head. At low speeds, the increased loads may deteriorate fuel economy.

U.S. Pat. No. 2,005,089 issued to Krebs on June 18, 1935 discloses an elastomeric tube placed about the coil spring. The tube compresses as the coil spring compresses to act as a secondary spring which must be overcome in order for the valve head to move to its open position.

It is desired to have a damper which does not appreciably increase the load needed to compress the spring and does not engage high stress areas of the coil spring. It is also desirable to have a damper which can be incorporated in existing engines.

SUMMARY OF THE INVENTION

According to the invention, a valve assembly for an internal combustion engine includes a valve member having a valve head and valve stem. A coil spring seat is axially fixed to the valve member. A coil spring comprising helical coils is interposed between a housing of the combustion engine and the coil spring seat on the stem to bias the valve member to a closed position. A sleeve member is constructed to be mounted about the coil spring and to frictionally engage the radially outer portion of a plurality of the helical coils. The sleeve member is constructed to be relatively rigid in the axial direction and radially resilient. The sleeve member, when mounted about the coil spring, exerts a radially directed force against the outer portion of the coils to assure that the coils frictionally slide thereagainst when the coils undergo axial motion. The frictional engagement of the sleeve with the coil spring damps the motion of the coil spring.

More particularly, the sleeve member is made from spring steel and has a longitudinal slot therethrough. The spring is resiliently biased to a first position that has a radius smaller than the outside radius of the coil spring. The sleeve is resiliently flexible in the radial direction to outwardly flex in order to receive the coil spring. In addition, the sleeve is radially flexible to accommodate change in the radius of the coil spring when the coil spring undergoes compression.

The broader aspects to the invention relate to a vibration damper for a coil spring that includes a sleeve member constructed to be axially rigid and mounted about the coil spring. The sleeve member is constructed to abut the radially outer portion of a plurality of coils of the spring and frictionally slide thereagainst when the coils undergo axial motion thereby damping the motion of the coils.

The coil spring vibration damper effectively damps the motion of the coil spring while maintaining the durability thereof. The vibration damper eliminates unwanted resonating of the coil spring without adding appreciable loads on a valve train that incorporates the design. A valve assembly is thus provided with a controlled resilient bias that renders an internal combustion engine with better fuel economy and better performance.

BRIEF DESCRIPTION OF THE DRAWINGS

Reference now will be made to the accompanying drawings in which.

DETAILED DESCRIPTION OF THE PREFERRRED EMBODIMENT

Figure 1:
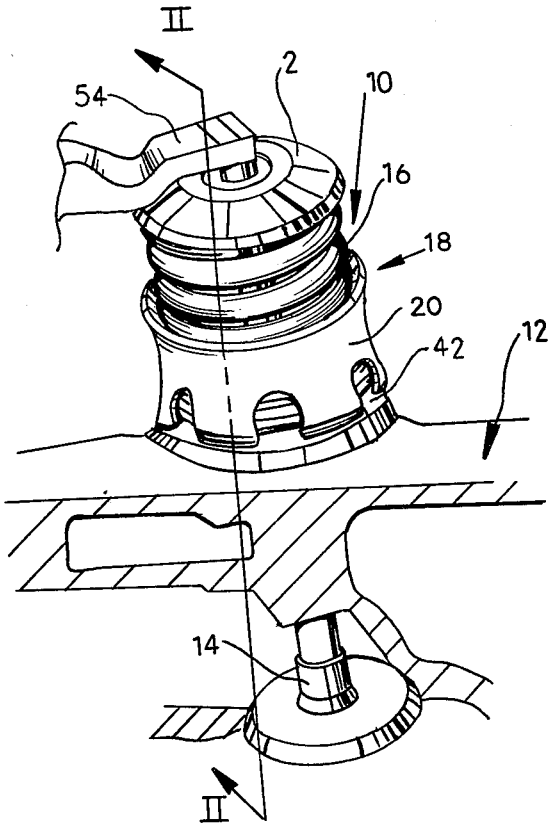
FIG. 1 is a perspective view of a valve assembly incorporating one embodiment of the invention.

Referring to FIG. 1, a valve assembly 10 for an internal combustion engine generally indicated as 12 includes a valve member 14 biased to a closed position by a helically coiled spring 16. The coil spring 16 has its upper end seated against a retainer 2 at its bottom end received within a sleeve 18.

Figure 3:
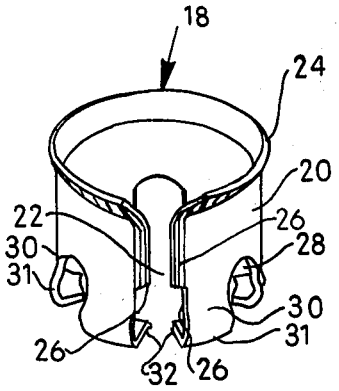
FIG. 3 is a perspective view of the sleeve shown in FIG. 1 in its unflexed positon.

The sleeve 18, as shown in FIG. 3, is made from a sheet of spring steel. The sheet is formed into a substantially cylindrical shape with a cylindrical wall 20 having a longitudinal slot 22 extending therethrough. The top end of the cylindrical wall 20 has a radially outwardly extending flange 24. In addition, radially outwardly extending flaps 26 are located adjacent the longitudinal slot 22. The bottom portion of the cylindrical wall 20 has arcuate notches 28 circumferentially spaced thereabout.

Figure 5:
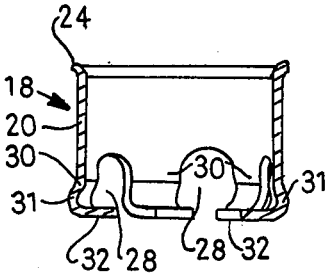
FIG. 5 is a cross-sectional view of the sleeve taken along the line V—V in FIG. 4.

As more clearly shown in FIG. 5, the sleeve 18 has sections 30 which downwardly extend between the notches 28. Each section 30 has a radially outwardly bent portion 31 and radially inwardly extending prong 32 as shown in FIG. 6.

Figure 6:
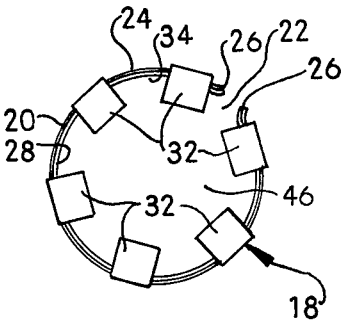
FIG. 6 is a bottom plan view of the sleeve shown in FIG. 3.
Figure 4:
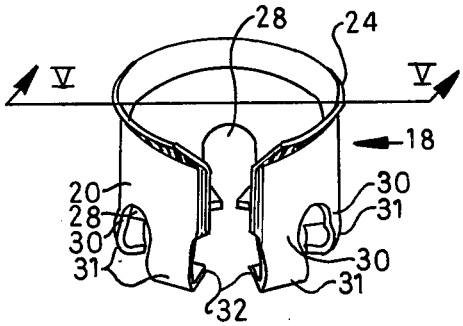
FIG. 4 is a perspective view similar to FIG. 3 showing the sleeve in its outwardly flexed position to receive the coil spring.
Figure 7:
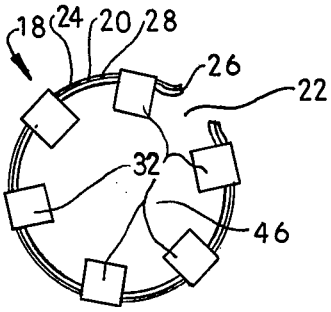
FIG. 7 is a bottom plan view of the sleeve shown in FIG. 4 in its outwardly flexed position.

The sleeve 18 has a natural unflexed position as shown in FIGS. 3 and 6. The inner diameter of the sleeve at this unflexed position is smaller than the outer diameter of the coil spring 16 shown in FIGS. 1 and 2. However, the sleeve 18 is able to radially flex outwardly to a position as shown in FIGS. 4 and 7. When the sleeve is flexed to this position with an enlarged radius, it is able to receive the coil spring 16 as illustrated in FIGS. 1 and 2.

Figure 2:
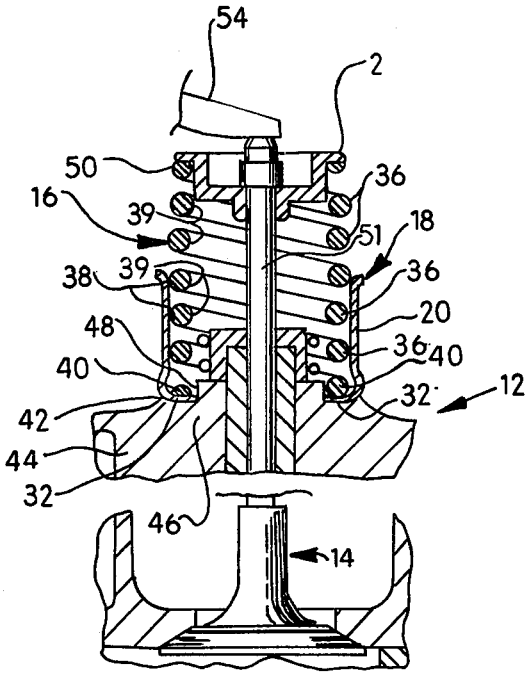
FIG. 2 is a partially segmented view taken along the line II—II shown in FIG. 1.

As shown more particularly in FIG. 2, sleeve 18 normally receives a plurality of helical coils 36 of coil spring 16. The remainder of coils 36 normally are not received in sleeve 18. The sleeve exerts a radially inwardly directed force against the radially outer facing surface 38 of the plurality of coils 36. The radially inner facing surfaces 39 are not in engagement with the sleeve. The radially extending bottom surface of end coil 40 is seated on prongs 32 which, in turn, are seated upon an annular seat 42 of cylinder head 44 of the engine 12. The prongs 32 are dimensioned to provide for a central aperture 46 sized to receive the annular shoulder 48 extending from seat 42.

The top coil 50 of coil spring 16 is seated against the spring retainer 2 which is secured to the valve stem 51 of valve member 14. The valve member 14 can be moved downwardly against the upward bias of the spring 16 by a downward force exerted by an appropriate actuation mechanism 54.

The coil spring as it compresses due to the actuation mechanism 54 has the radially outer facing surfaces 38 of coils 36 slide against the inside surface of wall 20. In addition, depending on the amount of spring compression one or more of the remaining coils 36 also enter within sleeve 18 and have their radially outer facing surfaces 38 engage wall 20. This sliding engagement of the coils 36 with the wall 20 results in frictional losses and thereby damps the motion of the coil spring.

It is also known that when the coil spring 16 compresses, its radius also enlarges. This enlargement is accommodated by the sleeve 18 radially flexing further outwardly responsive to the outwardly directed force exerted by the coils 36. The wall 20 maintains its frictional engagement with the coils 36.

As the spring elongates and the spring diameter becomes smaller, the resilient nature of the sleeve 18 causes the sleeve to flex inwardly to maintain its frictional contact with the radially outer facing surfaces 38 of the coils 36. The constant frictional contact effects continuous frictional damping on the coil spring 16.

To maintain the necessary clearances provided for in valve assemblies of internal combustion engines, the sleeve 18 has a height which is less than the height of the coil spring 16 when fully compressed (i.e., all the coils 36 contact each other with no space therebetween).

Furthermore, because prongs 32 are interposed between the bottom coil 40 and seat 42, the sleeve 18 remains seated on seat 42 and does not slide axially along spring 16. The fixing of sleeve 18 at the bottom end of spring 16 prevents the sleeve from any rapid motion along the spring which may result in it hitting another member and causing damage. Alternatively, the prongs 32 may be interposed between the spring 16 and the spring retainer 2.

Because the high stresses of the coil spring 16 occur at the radially inner facing surfaces 39 of the helical coils, frictional engagement of the spring sleeve 18 only with the outer facing surfaces 38 increases the spring's reliability and durability. Furthermore, the damping effect provided by the sleeve on the coil spring renders a more controlled spring and thereby provides for increased performance and fuel economy of an internal combustion engine which incorporates this coil spring damper.

In this fashion, an effective coil spring damper is provided that can be incorporated in many standard internal combustion engines.

Variations and modifications of the present invention are possible without departing from its scope and spirit as defined by the appended claims.

INDUSTRIAL APPLICABILITY

This invention has industrial applicability to internal combustion engines and provides a coil spring damper to damp undesirable resonance and vibrations in a coil spring for a valve assembly.

The embodiments of the invention which an exclusive property or privilege is claimed are defined as follows:

1. A spring and damper assembly characterized by:

a helical coil spring interposed between a sprung member and unsprung member with one end operably biased against said sprung member and its opposite end operably biased against said unsprung member, said spring adapted to undergo axial compression from a first position to a second more axially compressed position;

a sleeve member constructed to be rigid in an axial direction and mounted about said coil spring;

said sleeve member sized to frictionally engage the radial outer portions of a first plurality of helical coils of said spring, a remaining plurality of said helical coils not being engaged by said sleeve when said coil spring is in said first position, and to frictionally slide against the outer portion of said first plurality of coils when said coils undergo axial motion such that the frictional engagement of said sleeve with said coil spring damps the motion of said coil spring.

2. A spring and damper assembly characterized by:

a coil spring comprising helical coils interposed between a sprung member and unsprung member with one end of said spring operably biased against said sprung member and its opposite end operably biased against said unsprung member, said spring adapted to undergo axial compression from a first position to a second more axially compressed position;

an axially rigid sleeve member fitted about said coil spring and exerting a radially inwardly directed force against radial outer portions of a first plurality of said helical coils of said coil spring, a remaining plurality of said helical coils not being engaged by said sleeve when said coil spring is in said first position, such that said sleeve member frictionally engages the outer portion of said first plurality of coils and frictionally slides against said outer portion of said coils when said coils undergo axial motion to damp the motion of said coils; and said sleeve constructed to resiliently flex in the radial direction to accommodate change in diameter of said spring as said spring undergoes compression and tension.

3. A spring and damper assembly as defined in claim 1 wherein said sleeve member has radially inwardly extending prongs to abut a radially extending surface of at least one coil and axially fix said sleeve to said coil spring.

4. A spring and damper assembly as defined in claim 3 wherein;

said radially inwardly extending prongs are located at one end of said sleeve and abut the radial extending surface of an end of said coil spring; and said prongs are interposed between said end coil and one of said sprung and unsprung members.

5. A valve assembly for an internal combustion engine, said valve assembly characterized by:

a valve member including:

a valve head seated about a port through an engine housing;

a valve stem extending from said valve head; and a coil spring seat axially fixed to said valve stem, a coil spring comprising helical coils interposed between said engine housing and said coil spring seat about said stem to bias said valve member to a first position;

an axially rigid sleeve positioned about said coil spring to frictionally engage the radially outer portion of a plurality of coils of said coil spring, a remaining plurality of said coils not being engaged by said sleeve when said coil spring is in said first position;

said sleeve member constructed to frictionally slide against the outer portion of said engaged coils when said coils undergo axial motion to damp the motion of said coil spring.

6. A valve assembly as defined in claim 5 wherein;

said sleeve member has a longitudinal extending slot therethrough to allow said sleeve to flex about its central longitudinal axis in order to receive said coil spring; and, said sleeve member has a resilient bias to close about said coil spring and to frictionally abut the radially outer portion of said coils.

7. A valve assembly as defined in claim 6 wherein one end of said sleeve has inwardly radially extending prongs abutting the axial end of an end coil; and, said prongs are interposed between said end coil and said housing.

8. A valve assembly as defined in claim 7 wherein said sleeve has a radially extending flange at its other end.

9. A valve assembly as defined in claim 6 wherein said sleeve has radially outwardly extending flanges at the edge of the longitudinal slot.

10. A valve assembly for an internal combustion engine, said valve assembly characterized by:

a valve member including;

a valve head seated about a port through a housing;

a valve stem extending from said head; and a coil spring seat axially fixed to said valve stem;

a coil spring comprising helical coils interposed between said housing and said coil spring seat about said stem to bias said valve member to a first position;

means for moving said valve member to a second position against the bias of said coil spring;

a sleeve member having a longitudinal slot therethrough and constructed to be biased to a first radial position and resiliently movable to a second radially larger position; and said sleeve member, when in said second radially larger position, being sized to receive a plurality of coils of said coil spring and biased to said first position of frictionally abut the radially outer portion of said coils, a remaining plurality of said coils not being engaged by said sleeve when said coil spring is in said first position, such that, when said engaged coils axially move, said sleeve frictionally slides against said coils to damp the motion of said spring.

11. A vibration damper for a helical coil spring characterized by:

a sleeve member constructed to be axially rigid;

said sleeve member being radially and resiliently flexible to receive said coil spring, to accommodate change in diameter of said coils as said coil spring undergoes compression and tension, and to exert a radially inwardly directed force on a plurality of coils of said coil spring received within said sleeve, a remaining plurality of said coils not being engaged by said sleeve when said coil spring is not under compression, such that said radial outer portion of said engaged coils frictionally slide against said sleeve with said sleeve damping the motion of said coils when said coil spring undergoes compression and tension.

12. A vibration damper as defined in claim 11 wherein;

said sleeve member is formed from spring steel and has a longitudinal slot extending therethrough;

said sleeve has a resilient bias to a radial dimension smaller than the outer radius of said coil spring section received within said sleeve.

13. A vibration damper as defined in claim 12 further comprising means for fixing the axial position of said sleeve member with one portion of said coil spring.

14. A vibration damper as defined in claim 13 wherein said fixing means comprises prongs inwardly extending from said sleeve abutting a radially extending surface of at least one coil.

15. A vibration damper for a coil spring adapted to undergo axial compression from a first position to a second more axially compressed position, said vibration damber being characterized by:

a sleeve member constructed to be axially rigid;

said sleeve member being radially and resiliently flexible to receive said coil spring and to exert a radially inwardly directed force on a plurality of coils of said coil spring received within said sleeve, a remaining plurality of said coils not being engaged by said sleeve when said coil spring is in said first position, such that said sleeve frictionally slides against said radial outer portions of said engaged coils when said coil spring undergoes compression and tension to damp the motion of said coil spring.

16. A vibration damper for coil spring adapted to undergo axial compression from a first position to a second more axially compressed position, said vibration damber being characterized by:

a sleeve member constructed to be axially rigid and mounted about said coil spring and frictionally engaging the radially outer portion of a plurality of coils of said coil spring, a remaining plurality of said coils not being engaged by said sleeve when said coil spring is in said first position;

said sleeve member constructed to have said radially outer portion of said coils frictionally slide thereagainst when said engaged coils undergo axial motion to damp the motion of said spring.

* * * * *